US009240143B2

(12) United States Patent
Aubert et al.

(10) Patent No.: US 9,240,143 B2
(45) Date of Patent: Jan. 19, 2016

(54) ELECTROWETTING DISPLAY DRIVING SYSTEM

(71) Applicant: Samsung LCD Netherlands R & D Center B.V., Eindhoven (NL)

(72) Inventors: Jo Aubert, Roermond (NL); Henricus Petronella Maria Derckx, Weert (NL)

(73) Assignee: Amazon Technologies, Inc., Seattle, WA (US)

( * ) Notice: Subject to any disclaimer, the term of this patent is extended or adjusted under 35 U.S.C. 154(b) by 279 days.

(21) Appl. No.: 13/718,313

(22) Filed: Dec. 18, 2012

(65) Prior Publication Data

US 2013/0106821 A1 May 2, 2013

Related U.S. Application Data

(63) Continuation of application No. PCT/EP2011/060104, filed on Jun. 17, 2011.

(30) Foreign Application Priority Data

Jun. 18, 2010 (GB) ..... 1010295.2

(51) Int. Cl.
*G09G 3/34* (2006.01)

(52) U.S. Cl.
CPC ..... *G09G 3/34* (2013.01); *G09G 3/348* (2013.01); *G09G 3/3433* (2013.01); *G09G 2310/0289* (2013.01); *G09G 2320/0626* (2013.01); *G09G 2330/021* (2013.01); *G09G 2330/028* (2013.01)

(58) Field of Classification Search
CPC ..... G06F 13/04; G03H 1/12; G03H 1/22
See application file for complete search history.

(56) References Cited

U.S. PATENT DOCUMENTS

| | | | | |
|---|---|---|---|---|
| 6,184,874 | B1 | 2/2001 | Smith et al. | |
| 2010/0157399 | A1* | 6/2010 | Kroll et al. | 359/11 |
| 2010/0177026 | A1 | 7/2010 | Van Dijk et al. | |
| 2010/0284056 | A1 | 11/2010 | Giraldo | |
| 2010/0296149 | A1 | 11/2010 | Feenstra et al. | |
| 2010/0302615 | A1 | 12/2010 | Aubert et al. | |
| 2011/0169799 | A1* | 7/2011 | Yoon et al. | 345/211 |
| 2011/0242087 | A1* | 10/2011 | Ebisuno et al. | 345/212 |
| 2011/0317399 | A1* | 12/2011 | Hsu | 362/97.1 |
| 2012/0256898 | A1 | 10/2012 | Aubert et al. | |

FOREIGN PATENT DOCUMENTS

| | | | |
|---|---|---|---|
| CN | 1864191 | A | 11/2006 |
| CN | 101578545 | A | 11/2009 |
| EP | 1777690 | A2 | 4/2007 |
| TW | 200840173 | A | 10/2008 |
| TW | 200903414 | A | 1/2009 |
| TW | 200915266 | A | 4/2009 |

(Continued)

*Primary Examiner* — Michael Faragalla
(74) *Attorney, Agent, or Firm* — BainwoodHuang

(57) ABSTRACT

A display driving system for an electrowetting display device having at least one display element, the display driving system comprising a driver stage for the display element, the driver stage providing a display voltage to be applied to the display element in response to a data signal representing an image to be displayed, the driver stage including a variable source providing a variable voltage in dependence on the data signal, the display driving system including an offset source providing an offset voltage, the display voltage being the sum of the offset voltage and the variable voltage.

20 Claims, 4 Drawing Sheets

(56) References Cited

FOREIGN PATENT DOCUMENTS

| | | | |
|---|---|---|---|
| TW | 200933193 | A | 8/2009 |
| WO | 2004104671 | A1 | 12/2004 |
| WO | 2005036517 | A1 | 4/2005 |
| WO | 2006021912 | A1 | 3/2006 |
| WO | 2007057797 | A1 | 5/2007 |
| WO | 2007141218 | A1 | 12/2007 |
| WO | 2008059039 | A1 | 5/2008 |
| WO | 2008119774 | A1 | 10/2008 |
| WO | 2009/004042 | A1 | 1/2009 |
| WO | 2011051413 | A1 | 5/2011 |

* cited by examiner

ELECTROWETTING DISPLAY DRIVING SYSTEM

TECHNICAL FIELD

The present invention relates to an electrowetting display driving system and to a method of driving an electrowetting display device.

BACKGROUND

A known electrowetting display apparatus has a display driving system which controls the voltages applied to the display elements of the electrowetting display device. A disadvantage of the display driving system is the lack of versatility.

It is desirable to provide a display driving system for an electrowetting display apparatus that is more versatile.

SUMMARY

In accordance with embodiments, there is provided a display driving system for an electrowetting display device having at least one display element, the display driving system comprising a driver stage for the display element, the driver stage providing a display voltage to be applied to the display element in response to a data signal representing an image to be displayed, the driver stage including a variable source providing a variable voltage in dependence on the data signal, the display driving system including an offset source providing an offset voltage, the display voltage being the sum of the offset voltage and the variable voltage.

Embodiments also relate to a display apparatus including an electrowetting display device and a display driving system as set out above.

Further embodiments relate to a method of driving an electrowetting display device having at least one display element, the display element providing a display state in response to a display voltage, the method including the step of forming the display voltage by adding an offset voltage and a variable voltage, the variable voltage depending on a data signal representing an image to be displayed.

Further features will become apparent from the following description of embodiments, given by way of example only, which is made with reference to the accompanying drawings.

DETAILED DESCRIPTION

Figure 1:
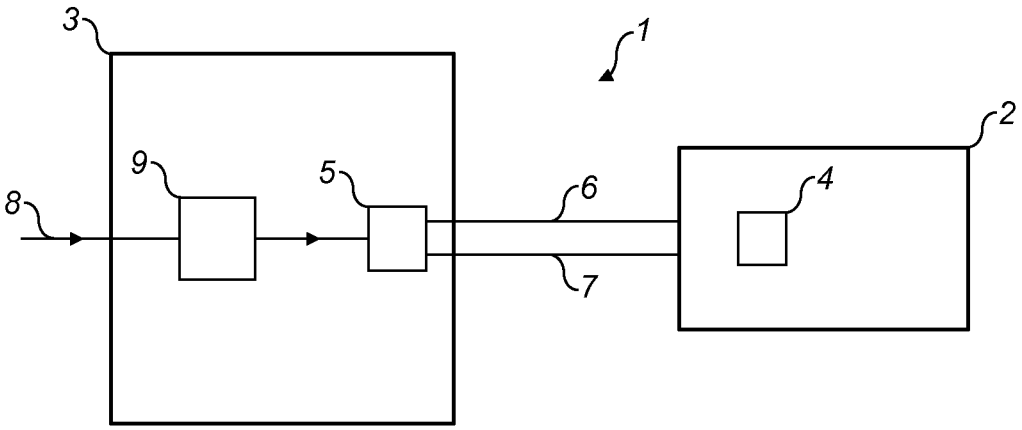
FIG. 1 shows a display apparatus including a display element.

The entire contents of the following patent documents are incorporated by reference herein:

1. GB 1010295.2 filed Jun. 18, 2010
2. PCT/EP2011/060104 filed Jun. 17, 2011

Prior to describing examples of embodiments in detail, embodiments will firstly be described in summary form.

In accordance with embodiments, there is provided a display driving system for an electrowetting display device having at least one display element, the display driving system comprising a driver stage for the display element, the driver stage providing a display voltage to be applied to the display element in response to a data signal representing an image to be displayed, the driver stage including a variable source providing a variable voltage in dependence on the data signal, the display driving system including an offset source providing an offset voltage, the display voltage being the sum of the offset voltage and the variable voltage.

An offset voltage is applied to increase the versatility of the display driving system. Known driver stages are variable sources that can vary the voltage applied to the display element between zero volt and a certain maximum voltage. The driver stage according to the embodiments, however, can vary the voltage between the offset voltage and a maximum voltage. The use of the offset voltage is based on the properties of the display element. The voltage applied to the display element must exceed a certain threshold value before a display effect occurs. Hence, variation of the voltage below this threshold does not provide a display effect and an offset voltage as high as the threshold voltage may be used.

Electronic components have a maximum operating voltage, usually depending on their manufacturing process. The driver stage is therefore constrained by the maximum output voltage swing that can be accommodated by the electronic components of which the driver stage is made. For example, some integrated circuits limit the output voltage swing to 30 volts.

When the driver stage has the same maximum output voltage as a known driver stage, the variable source according to the embodiments can have a lower voltage swing than the known variable source. This means that a manufacturing process with a lower maximum voltage can be used for the driver stage, providing a lower manufacturing cost, a lower power consumption, a smaller footprint and/or a better availability.

When the driver stage according to embodiments uses a variable source having the same voltage swing as the prior art driver stage, a larger maximum output voltage of the driver stage and an appertaining brighter image can be attained without a relatively expensive variable source that would be required for a prior art driver stage and without increasing the power consumption within the variable source.

The offset voltage corresponds to a threshold voltage of the display element. If the offset voltage is equal to the threshold voltage, a maximum increase of the brightness of the image or maximum reduction of the voltage swing can be achieved.

The offset voltage may be adjustable. An adjustable offset voltage, e.g. in dependence on the content of the image to be displayed, increases the versatility of the system. When the offset voltage is set at a low level, for example near zero volts, the maximum output voltage of the driver stage is relatively low and the power consumption is also relatively low. The lower brightness of the image is suitable for content that can typically be viewed at lower brightness, such as displaying video content or photographs.

When the offset voltage is set at a high level, e.g. 10 volts, the maximum output voltage is relatively high. The resulting high brightness can be used for viewing content such as internet content, text on white background or images with much detail.

Varying the off-set voltage allows further power management versatility. The higher brightness mode may be used in dependence on the content of the image. If the offset voltage is reduced to a low voltage, for instance 0V, the offset source may be switched off, thereby limiting the power consumption in that component. When the offset voltage is larger than 0V, one can save power of the variable source by reducing its voltage swing.

In an embodiment the variable source has an adjustable voltage swing. The voltage swing is the difference between the minimum and maximum voltage of the variable source in response to the data signal. An adjustable voltage swing allows setting the swing to a relatively low value for a low-brightness image and low power consumption and to a relatively high value for a high-brightness image.

A combination of adjustable offset voltage and adjustable voltage swing provides a large versatility in choice between brightness level and power consumption.

In another embodiment the electrowetting display device includes a plurality of display elements having a common electrode, and each display element having an element electrode, the display voltage of a display element being applied between the common electrode and the element electrode, and an output of the offset source being connected to the common electrode.

The common electrode allows to simplify the display driving system in that a single offset source can be connected to the common electrode, the offset source being shared by the plurality of driver stages.

Embodiments also relate to a display apparatus including an electrowetting display device and a display driving system as set out above.

Further embodiments relate to a method of driving an electrowetting display device having at least one display element, the display element providing a display state in response to a display voltage, the method including the step of forming the display voltage by adding an offset voltage and a variable voltage, the variable voltage depending on a data signal representing an image to be displayed.

The offset voltage may correspond to a threshold voltage of the display element.

The offset voltage is adjustable. The variable voltage may have an adjustable voltage swing.

Examples of embodiments will now be described in detail.

FIG. 1 shows schematically a display apparatus 1 including an electrowetting display device 2 and a display driving system 3. The display device has at least one display element 4. A driver stage 5 in the display driving system is connected to the display device by means of signal lines 6 and 7. The driver stage outputs a display voltage in response to a data signal input to the display driving system by a data signal line 8, the data signal representing a display state to be shown by the display device 2. When the display device includes a two-dimensional array of display elements, such as an active matrix array, the data signal may be a TV signal and the combined display states of the display elements forms an image. The display driving system may include a display controller 9 connected to the data signal line 8 and providing signal levels and timing for the control of the display element. The driver stage 5 transforms the output of the display controller 9 to a signal suitable for controlling the display element 4.

Figure 2:
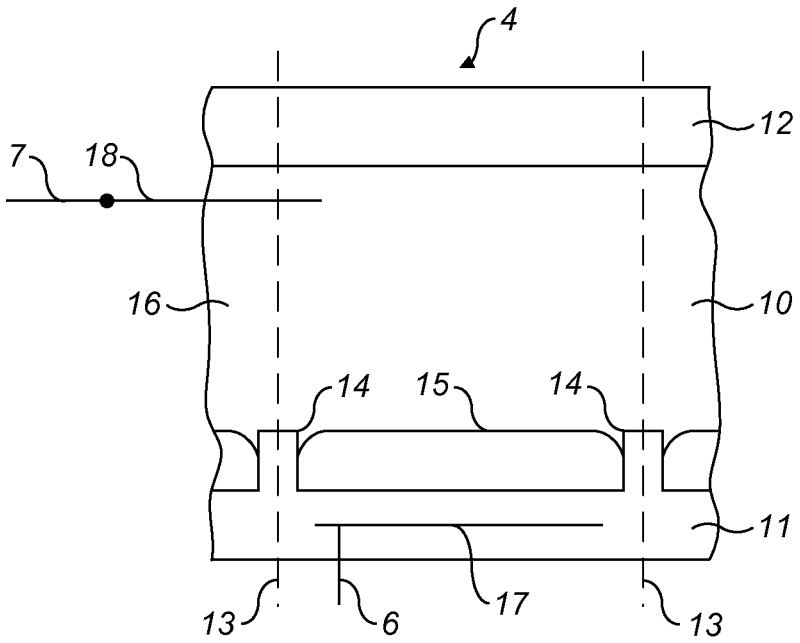
FIG. 2 shows a cross-section of a display element.

The display element 4, shown in cross-section in FIG. 2, includes a space 10 between a first support plate 11 and a second support plate 12, the lateral extent of the display element, indicated by the dashed lines 13, being limited by walls 14. The space 10 comprises a first fluid 15 and a second fluid 16, the first fluid being immiscible with the second fluid and the second fluid being electrically conductive or polar. The first support plate 11 includes an element electrode 17, electrically insulated from the space. The element electrode is connected directly or indirectly to the signal line 6. A common electrode 18 is in contact with the second fluid 16 and is connected directly or indirectly to the signal line 7. A display voltage, output from the driver stage 5, is applied to the electrodes via the signal lines 6 and 7. The position of the first and second fluid within the display element depends on the voltage applied to the electrodes, which position determines the display effect of the display element. Details of the construction and operation of the display element have been disclosed in FIG. 1 and the relating part of the description of international patent application WO2008/119774.

Figure 3:
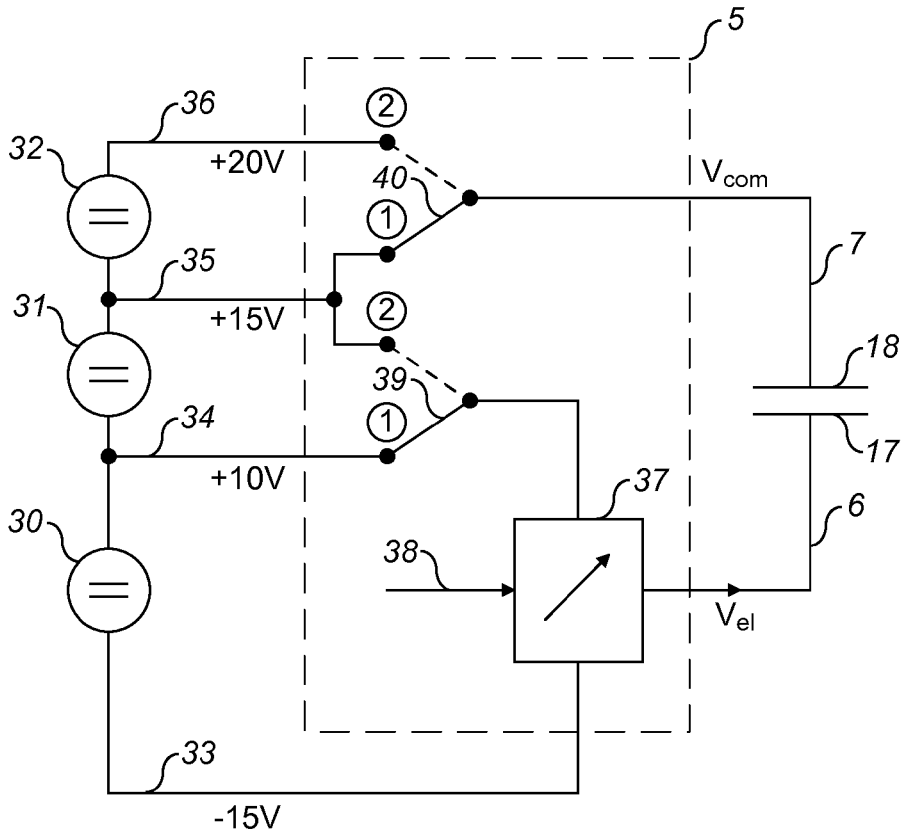
FIG. 3 shows a circuit diagram of a driver stage for a display element.

FIG. 3 shows a circuit diagram of an embodiment of the driver stage 5 and the electrodes 17 and 18 of a display element. Three DC sources 30, 31 and 32 are connected in series. In the embodiment shown, the source 30 provides a voltage of 25 V and the sources 31 and 32 each 5 V, thereby providing four supply lines 33, 34, 35 and 36 having the voltage levels of −15 V, +10 V, +15 V and +20 V, respectively. A driver 37 receives as input a signal 38 from the controller 9, for setting the display state of the display element. The output of the driver 37, the electrode voltage Vel, is connected to the signal line 6, which in turn is connected to the element electrode 17 of the display element. In a simple embodiment the driver 37 is an amplifier that transforms an incoming analog signal into an analog output signal having the voltage level required for controlling the movement of the fluids 15 and 16 in the display element. The driver 37 is fed by the power lines 33 and 34 or 35. The selection between power lines 34 and 35 is made by a switch 39. The common electrode 18 is at a common voltage level Vcom and is connected to either power line 35 or 36, the selection being made by a switch 40. The driver 37 and the switches 39 and 40 are part of the driver stage 5 for the display element 4.

Table I shows various voltages in the circuit of FIG. 3 in four modes determined by the settings of the switches 39 and 40.

TABLE I

Voltages in circuit of FIG. 3

| Mode | Position switch 39 | Position switch 40 | Vel (V) | Vcom (V) | Vdisplay (V) | Voltage swing (V) |
|---|---|---|---|---|---|---|
| 1 | 2 | 1 | −15-+15 | +15 | 0-30 | 30 |
| 2 | 1 | 1 | −15-+10 | +15 | 5-30 | 25 |
| 3 | 2 | 2 | −15-+15 | +20 | 5-35 | 30 |
| 4 | 1 | 2 | −15-+10 | +20 | 10-35 | 25 |
| 5 | | | −15-+15 | +20 | 10-40 | 30 |

The fourth column of the table shows the range of voltages Vel that can be applied to the element electrode 17. The extent of the range is determined by the supply voltages of the driver 37. The actual value of Vel is dependent on the data signal. The fifth column shows the voltage Vcom applied to the common electrode 18.

The sixth column shows the range of voltages Vdisplay, defined as (Vcom−Vel), that can be applied to the display via the electrodes 17 and 18, and which determines the display effect of the display element. This voltage shows an offset voltage of 0, 5 or 10 V, depending on the settings of the switches 39 and 40. The seventh column shows a voltage swing of Vdisplay, i.e. the maximum Vdisplay minus the minimum Vdisplay. Its value is 25 or 30 V, depending on the setting of the switch 39.

Figure 4:
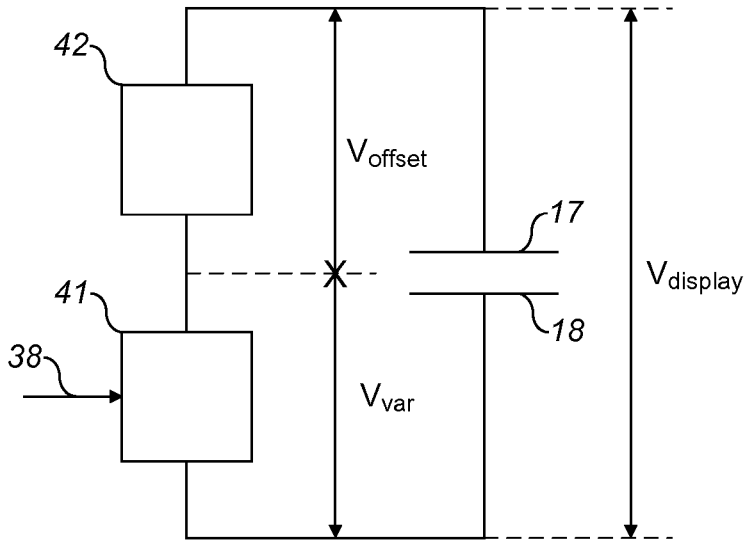
FIG. 4 shows an alternative rendering of the circuit diagram of FIG. 3.

In view of the offset voltage and the voltage swing, the circuit diagram of FIG. 3 can be represented in a more general way by the circuit diagram shown in FIG. 4. The voltage Vdisplay applied to the electrodes 17 and 18 is the sum of a variable voltage Vvar and an offset voltage Voffset. Vvar is output by a variable source 41. The level of Vvar depends on the data signal, here shown as signal 38. The maximum swing of Vvar may be adjustable. In the embodiment of FIG. 3 the variable source is formed by the driver 37 together with the sources 30 and 31 and the switch 39. The maximum swing of the variable source is set by the switch 39.

Voffset is a voltage output by an offset source 42. Voffset may have an adjustable level. In the embodiment of FIG. 3 the offset source is formed by the sources 31 and 32 and the switches 39 and 40. The level of Voffset is set by the switches 39 and 40.

Figure 5A:
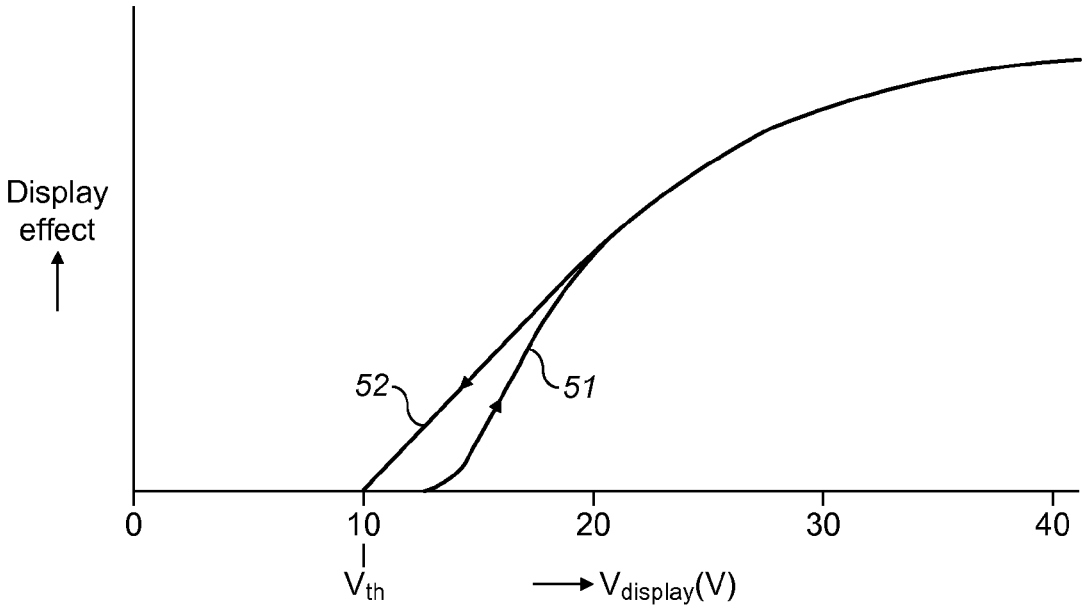
FIGS. 5*a* and 5*b* show a graph presenting the display effect of a display element with and without hysteresis as a function of the voltage applied to the display element.
Figure 5B:
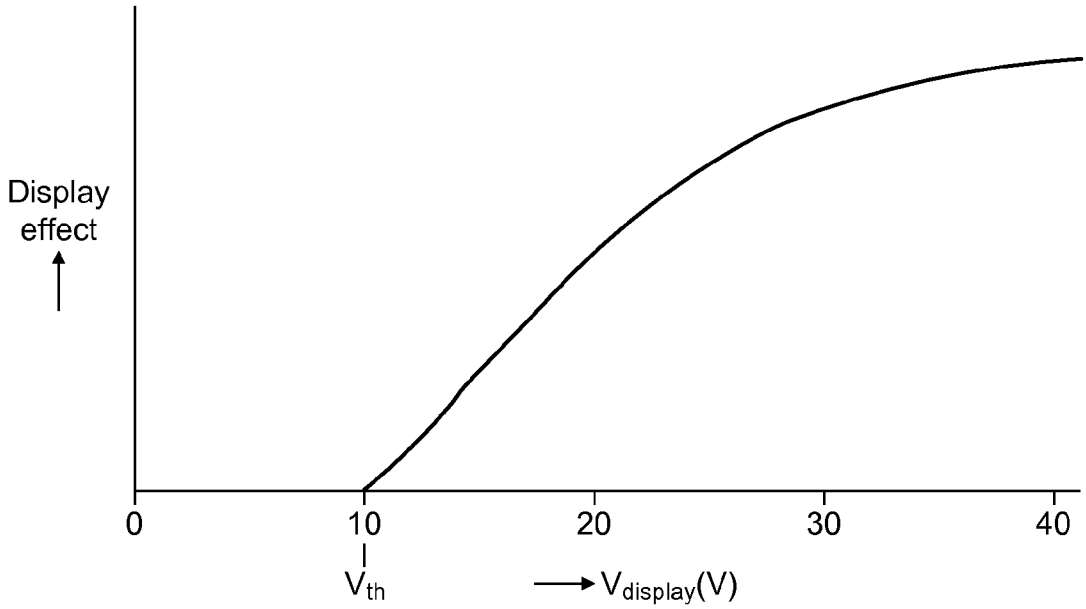

The effect of the offset voltage and the variable voltage is shown in FIGS. 5*a* and 5*b*, where the display effect is presented as a function of the display voltage Vdisplay, for two different cases. In the first case, shown in FIG. 5*a*, the display effect as a function of display voltage shows hysteresis, meaning that the display effect is not necessarily the same when the display voltage is increased from 0 V to a high value (line 51) as when the display voltage is decreased from a high voltage to a low voltage (line 52). FIG. 5*b* shows the display effect as a function of display voltage for a case without hysteresis. In both cases, the display effect may be the transmission or reflectivity of the display element, each of which increases when the first fluid contracts under the influence of the applied display voltage. A high display effect corresponds to a bright image. At low display voltages, there is no display effect. The threshold voltage which represents an example of an offset voltage is indicated in FIGS. 5*a* and 5*b* as Vth. Although the figures indicate the same threshold voltage for a display effect with and without hysteresis, they are usually different and depend on the specific construction of the display element. In the case of a hysteretic curve, the threshold voltage is the display voltage where, at decreasing display voltage (line 52), the display effect disappears. In the case of a non-hysteretic curve, the threshold voltage is the display voltage at which a display effect starts to occur. The use of the offset voltage in embodiments is related to the absence of a display effect for display voltages lower than the threshold voltage.

In mode 1 of Table I there is a zero offset voltage and the display voltage varies between 0 and 30 V because the maximum voltage amplitude provided by driver 37 is 30 V. This is the normal mode of operation of the display apparatus when no voltage offset is applied and is a mode of operation known from the prior art display apparatuses.

In mode 2 the display voltage varies between 5 and 30 V. Since the maximum voltage is the same as in mode 1, the same display effect can be attained; in other words, the images in mode 1 and 2 will be equally bright. However, the power consumption of the variable source 40 is reduced by a factor $(30/25)^2=1.44$, because in mode 2 the voltage swing is now reduced from 30 to 25 V. Mode 2 is suitable, for example, for viewing video content or photographs at low brightness.

In mode 3 of Table I the voltage swing is equal to that in mode 1, but it is now superposed on a 5 V offset voltage instigated by an increase of Vcom from +15 to +20 V. The result is a brighter image than in mode 1, because the maximum display voltage is higher (35 V). However, the power consumption of the variable source is the same as in mode 1. Mode 3 is suitable, for example, for viewing internet content, text on white background or images with much detail.

In mode 4 the offset voltage has been increased compared to mode 2, causing a brighter image. For a given voltage swing, the highest display effect is obtained if the offset voltage corresponds to the threshold voltage of the display element. The offset voltage may be set at a level 5 or 10% below the average threshold voltage of the display elements to avoid any issues with threshold non-uniformity between display elements or threshold shifts over time.

In mode 5 of Table I the display voltage varies between 10 and 40 V, giving a very bright display. This has been achieved by an offset voltage of 10 V and a voltage swing of 30 V. It is the brightest display that can be achieved when (1) the display element has a threshold voltage of 10 V, determining the offset voltage, (2) the driver 37 has a maximum voltage swing of 30 V, and (3) the display element should be able to show display effects down to a display voltage equal to the threshold voltage. Note, that the circuit shown in FIG. 3 requires modification to attain a 10 V offset and a 30 V voltage swing.

When the offset voltage is set at the threshold voltage or slightly higher, the effect of hysteresis as shown in FIG. 5*a* will become less noticeable when driving the display element. After the display element has traversed line 51 on initiation of the display device, it will show a smaller hysteresis than that shown in FIG. 5*a* or no hysteresis at all, depending on the level of the offset voltage. When the offset voltage is slightly higher than the threshold voltage, the first fluid 15 in FIG. 2 will be slightly contracted at the minimum variable voltage, causing the second fluid 16 to adjoin the first support plate 11 at all times during the display addressing. In the example display curve of FIG. 5*a*, an offset voltage that is 1-2 V higher than the threshold voltage causes a minimum adjoinment of the second fluid of 2-3% of the area of the display element between the walls 14. Such an area of minimum adjoinment strongly reduces or even eliminates the effect of hysteresis. Since the offset voltage will be applied to the display element during subsequent display states, the first fluid will not go back to the non-contracted state between different display states; hence, the reduction of the hysteresis effect will be maintained.

The effect of this minimum adjoinment on the display effect can be reduced by using a preferential initiation point and making the area of minimum adjoinment non-contributing to the display effect. A preferential initiation point causes the first fluid to start contracting at the same point in the display element when applying a voltage and can be realised in various ways, such as by controlling the electric field in the display element, as set out in e.g. international application WO 2004/104671; the shape of the display element, as set out in e.g. WO 2006/021912; or the wettability of the hydrophobic surface of the display element as set out in e.g. WO 2007/141218. The area of minimum adjoinment can be made non-contributory to the display effect for example by colouring the area black, as disclosed in e.g. WO 2007/141218.

The embodiments show various possible settings of the offset voltage. Any setting of the offset voltage can be combined with any method of controlling the variable voltage to achieve a desired display state. It can be combined, for example, with various methods to achieve gray scales in the displayed image, such as applying amplitude modulation, applying pulse-width modulation, applying dithering or applying a combination of these different methods.

The embodiment of FIG. 3 can be used in a direct-drive display apparatus. When the display apparatus includes a plurality of display elements, each one of them can be controlled by a driver 37. The power supply and the switches 39 and 40 may be shared by the plurality of drivers 37. The plurality of display elements may share the second fluid 16, as indicated in FIG. 2, thereby requiring only one electrode 18, set at the common voltage Vcom.

Figure 6:
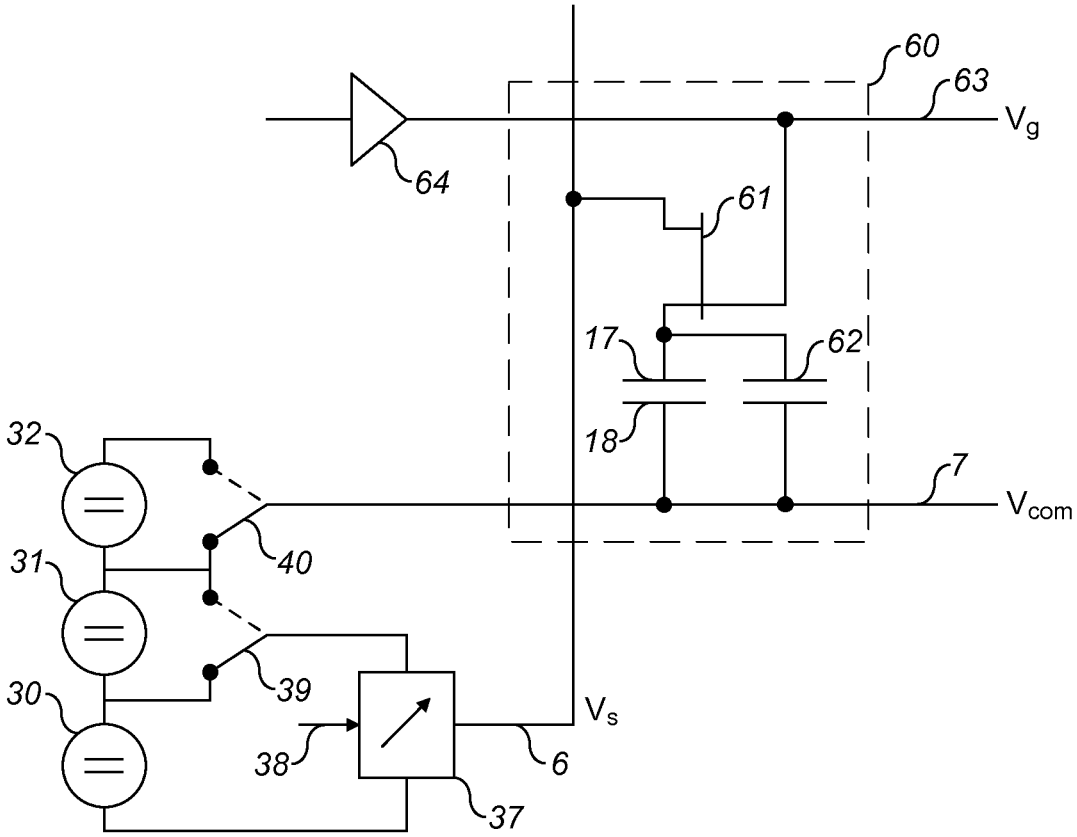
FIG. 6 shows a circuit diagram of a driver stage for an active-matrix display element.

When the plurality of display elements is arranged in a matrix form having rows and columns of display elements, the control of the display elements can be achieved by one driver 37 for each column of display elements. A small modification of the circuit, as shown in FIG. 6, allows it to be used in such an active-matrix display apparatus. The active-matrix display device includes a plurality of display elements arranged in a matrix of rows and columns. FIG. 6 shows the circuit for one of the display elements 60, including an active element in the form a transistor 61. The electrodes 17, 18 of the display element are indicated again as a capacitor. The electrode 18 is common to the plurality of display elements and is connected to the electrically conducting second fluid 16 that is shared by the display elements. The display element may include a capacitor 62 for storage purposes. This capacitor is arranged in parallel with the capacitor 17, 18. The line connecting the capacitor to ground is the common signal line 7 at voltage Vcom.

The signal line 6 is connected to the transistor 61, providing a source voltage Vs. The gate of the transistor is connected to a signal line 63 at a gate voltage Vg. The signal for line 63 is provided by a driver 64. The transistor 61 acts as a switch controlled by the gate voltage Vg that can connect the source voltage Vs to the capacitors. The driver 64 acts as a row driver for activating the transistors in a row of the display device. The driver 37 acts as a column driver for providing the source voltage for a column of display elements. The operation of the active-matrix display driving system and display device has been disclosed in FIGS. 3 and 4 and the relating part of the description of international patent application WO2008/119774.

The above embodiments are to be understood as illustrative embodiments. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

The invention claimed is:

1. A display driving system for an electrowetting display device having a display element, the display driving system comprising a driver stage for the display element, the driver stage configured to provide a display voltage to be applied to the display element in response to a data signal representing an image to be displayed, the driver stage including a variable source configured to provide a variable voltage in dependence on the data signal, the display driving system including an offset source configured to provide an offset voltage, the display voltage being the sum of the offset voltage and the variable voltage.

2. A display driving system according to claim 1, wherein the offset voltage corresponds to a threshold voltage of the display element.

3. A display driving system according to claim 1, wherein the offset voltage is adjustable.

4. A display driving system according to claim 1, wherein the variable source has an adjustable voltage swing.

5. A display driving system according to claim 1, wherein the electrowetting display device includes a plurality of display elements including the display element and having a common electrode, and each display element of the plurality of display elements having an element electrode, the display voltage of the display element being appliable between the common electrode and the element electrode of the display element, and an output of the offset source being connected to the common electrode.

6. A display apparatus including an electrowetting display device having a display element and a display driving system comprising a driver stage for the display element, the driver stage configured to provide a display voltage to be applied to the display element in response to a data signal representing an image to be displayed, the driver stage including a variable source configured to provide a variable voltage in dependence on the data signal, the display driving system including an offset source configured to provide an offset voltage, the display voltage being the sum of the offset voltage and the variable voltage.

7. A display apparatus according to claim 6, wherein the offset voltage corresponds to a threshold voltage of the display element.

8. A display apparatus according to claim 6, wherein the offset voltage is adjustable.

9. A display apparatus according to claim 6, wherein the variable source has an adjustable voltage swing.

10. A display apparatus according to claim 6, wherein the electrowetting display device includes a plurality of display elements including the display element and having a common electrode, and each display element of the plurality of display elements having an element electrode, the display voltage of the display element being appliable between the common electrode and the element electrode of the display element, and an output of the offset source being connected to the common electrode.

11. A method of driving an electrowetting display device having a display element, the display element configured to provide a display state in response to a display voltage, the method including forming the display voltage by adding an offset voltage from an offset source and a variable voltage from a variable source, the variable voltage depending on a data signal representing an image to be displayed.

12. A method according to claim 11, wherein the offset voltage corresponds to a threshold voltage of the display element.

13. A method according to claim 11, wherein the offset voltage is adjustable.

14. A method according to claim 11, wherein the variable voltage has an adjustable voltage swing.

15. A method according to claim 11, wherein the electrowetting display device includes a plurality of display elements including the display element and having a common electrode, and each display element of the plurality of display elements having an element electrode, the display voltage of the display element being applied between the common electrode and the element electrode of the display element, and the offset voltage being applied to the common electrode.

16. A display driving system according to claim 1, wherein the offset voltage is adjustable in dependence on a content of the image to be displayed.

17. A display driving system according to claim 1, wherein the display element comprises a first fluid and a second fluid immiscible with the first fluid, wherein the offset source is configured to provide the offset voltage with a magnitude such that, with the offset voltage applied to the display element, the first fluid and the second fluid adjoin a support plate of the electrowetting display device.

18. A display driving system according to claim 17 configured to, at all times during addressing of the display element, apply the offset voltage to the display element.

19. A display apparatus according to claim 6, wherein the display element comprises a first fluid and a second fluid immiscible with the first fluid, wherein the offset source is configured to provide the offset voltage with a magnitude such that, with the offset voltage applied to the display element, the first fluid and the second fluid adjoin a support plate of the electrowetting display device.

20. A display apparatus according to claim 19, wherein the display driving system is configured to, at all times during addressing of the display element, apply the offset voltage to the display element.

* * * * *